US005950725A

United States Patent [19]

Rondeau et al.

[11] Patent Number: 5,950,725

[45] Date of Patent: Sep. 14, 1999

[54] HYDRAULIC WIPER PLUG LAUNCHER

[75] Inventors: Joel Rondeau, Antony, France; Jason Jonas, Houston, Tex.

[73] Assignee: Schlumberger Technology Corporation, Sugar Land, Tex.

[21] Appl. No.: 08/940,160

[22] Filed: Sep. 30, 1997

[51] Int. Cl.[6] ..... E21B 33/068

[52] U.S. Cl. ..... 166/70; 166/177.4

[58] Field of Search ..... 166/70, 177.4, 166/75.15

[56] References Cited

U.S. PATENT DOCUMENTS

| | | | |
|---|---|---|---|
| 2,481,422 | 9/1949 | Haynes et al. | 166/156 |
| 3,076,509 | 2/1963 | Burns et al. | 166/70 |
| 3,971,436 | 7/1976 | Lee | 166/70 |
| 4,246,967 | 1/1981 | Harris | 166/291 |
| 4,674,573 | 6/1987 | Bode | 166/291 |
| 4,775,008 | 10/1988 | Cameron | 166/70 |
| 5,165,474 | 11/1992 | Buisine et al. | 166/242 |
| 5,285,852 | 2/1994 | McLeod | 166/379 |
| 5,443,122 | 8/1995 | Brisco | 166/285 |

FOREIGN PATENT DOCUMENTS 0 377 255 B1 1/1994 European Pat. Off. .

OTHER PUBLICATIONS

Leo Burdylo and George Birch, Schlumberger Dowell, "Primary Cementing Techniques", *Well Cementing,* (Nelson) Elsevier Scientific Publications (1990).

*Primary Examiner*—Hoang C. Dang
*Attorney, Agent, or Firm*—John E. Vick, Jr.; Douglas Y'Barbo

[57] ABSTRACT

A hydraulic wiper plug launcher (8) includes a coupler (22) releasably mounted on the upper end of a well casing (9). The outer coupler body (10) has an inner shoulder (49) and an open ended plug container (12) has a stack of wiper plugs (16) compressed therein. The upper end portion of container (12) forms a fluid chamber (S2) above the uppermost wiper plug (16). A precise predetermined volume of fluid is supplied to fluid chamber (S2) for expelling the plugs (16) in a controlled sequence. The length of the fluid chamber (S2) in container (12) increases an amount equal to the length of the wiper plug (16) pushed or expelled from the open lower end of the container (12).

17 Claims, 4 Drawing Sheets

HYDRAULIC WIPER PLUG LAUNCHER

FIELD OF THE INVENTION

This invention relates generally to the cementing of casing strings in wells, and more particularly to a hydraulic plug launcher for launching wiper plugs for separation of a column of a predetermined fluid from drilling muds and other well fluids.

BACKGROUND OF THE INVENTION

After a borehole has been drilled into the earth, a string of steel casing is lowered and set therein. One or more drillable float shoes having an upwardly closing check valve are mounted on or near the lower end of the string to prevent back flow. A cement slurry is pumped down the interior of the casing string and out into the borehole via the check valves where it flows up in the annulus outside the casing to a desired level.

It is highly desirable to protect the cement slurry from contamination by the drilling mud as the slurry is being pumped into the well. The usual practice to protect it is to place a first wiper plug ahead of the cement column which provides a separation between the lower end of such column and the mud, and to place a second wiper plug which performs the same function at the top of the column. Each plug typically has a series of upwardly facing elastomer cups or fins whose outer edges engage the inner walls of the casing to provide sliding seals and wipers. When the first plug lands against a float shoe at the bottom of the casing, a passage is opened up through it which enables cement to be pumped into the annulus. Eventually the second plug lands against the first plug as the displacement is completed. The check valves in the float shoes prevent back flow of the cement into the casing during the time that it takes for the cement to set up. During the downward movement the outer edges of the fins of the second plug wipe or scrape the cement off of the inner walls of the casing so that no deposits are left. Once the cement is hardened, the plugs and cement shoes can be drilled out.

The plugs have annular elastomeric cups or fins that are inwardly compressed within an open-bottomed cylindrical basket near the top of the casing and held in the basket by frictional contact against the inner periphery of the basket. The cement wiper plugs are force-fitted within the basket which temporarily reduces their respective outer diameters. A push rod has a lower end in engagement with the upper wiper plug in the basket and the upper end of the push rod is connected to a hydraulically actuated piston such as shown in European Publication No. 0377255 B1published Jan. 19, 1994. The piston and push rod are mounted for downward movement a distance equal to the length of the two cement plugs. The push rod pushes the first plug out from the open lower end of the basket to form the lower end of the column of cement. The push rod pushes the second wiper plug out from the open lower end of the basket to define the upper end of the column of cement.

Upon expulsion of a plug, the plug expands radially outward to its relaxed diameter where the outer edges of its fins engage the inner wall of the casing. The lower plug moves ahead of a column of cement which is being pumped down the running string and out of lateral ports. From there the cement flows through an annular space between the basket and the inner wall of the casing. At the appropriate time, the upper cement wiper plug also is ejected from the basket and launched into the casing at the upper end of the column of cement. This plug expands like the first one to provide a moving seal that prevents contamination of the upper end of the cement column. The operation of the launcher is controlled from a remote location and the plugs do not require any reloading.

Some cement heads including an upper removable cap and may be loaded with another wiper plug after the launching of a plug. The cap on the upper end of the cement head is removed for reloading of a plug and then replaced after loading. However, the reloading of a plug into the cement head is time consuming and cumbersome with several workmen sometimes required for reloading the cement head with a new plug.

It has been found in many instances that more than two wiper plugs are desirable for multiple interfaces between different fluids. When more than two wiper plugs are utilized, the length of each stroke of the piston is equal to the length of the ejected wiper plug. For example, if four cement wiper plugs, each with a length of fifteen (15) inches, are utilized, the total stroke of the piston would have to be five (5) feet in order to eject or discharge all of the plugs from the lower end of the basket. The basket would also be at least five (5) feet in length in order to receive the plugs. Vertical space on the floor of a drilling rig or derrick is at a premium and is needed for a variety of operations. The cylinder which receives the piston above the basket has a pressurized hydraulic chamber over the piston and would extend substantially over five (5) feet above the basket.

It is an object of the present invention to provide a hydraulic cement launcher particularly adapted for three or more wiper plugs with the launcher being of a minimum height above the wiper plugs.

A further object of the invention is the provision of such a wiper plug launcher in which the basket receiving the wiper plugs forms a fluid pressurized cylinder for receiving actuating hydraulic fluid for ejecting the wiper plugs.

SUMMARY OF THE INVENTION

The present invention is particularly directed to a wiper plug launching system in which a plurality of cement wiper plugs, preferably three to five plugs, are housed within an open-ended cylindrical basket or container and held therein by frictional contact with the inner peripheral surface of the basket. The plugs are stacked on each other and the uppermost plug is a solid plug acting as a piston to push subjacent plugs from the bottom of the basket. The basket or container forms a hydraulic fluid chamber over the upper plug and the hydraulic fluid chamber increases lengthwise as the wiper plugs are successively pushed from the open lower end of the container. An increase of the length of the hydraulic fluid chamber occurs in a plurality of segmented steps, each step equal to the length of the wiper plug expelled or pushed from the lower end of the open ended container.

The upper solid plug which acts as a piston pushes the lower wiper plugs from the end of the plug container and the movement of the solid plug for the expelling of a lower plug is equal precisely to the length of the plug being expelled or ejected from the container. To determine the movement of the solid plug accurately, a precise volume of hydraulic fluid may be discharged into the hydraulic fluid chamber formed by the container. The precise movement of the solid plug may be determined by various means such as, for example, (1) the precise measurement of fluid discharged into the basket, or (2) a sensor indicating the exact position of the upper solid plug for controlling a control valve for the supply of hydraulic fluid to the plug container. The volume of fluid supplied to the fluid chamber or the amount of axial movement of the stack of cement wiper plugs may be determined by various means. Stops may be provided to effect accurate axial movement of the wiper plugs, or the volume of hydraulic fluid supplied to the hydraulic fluid chamber may be precisely calculated and measured.

From the above, it is apparent that a minimal height wiper plug launching system is provided by the present invention in utilizing the container or basket housing the wiper plugs as a hydraulic fluid chamber with the upper wiper plug acting as a piston to push lower plugs from the container. For example, when utilizing a hydraulic launcher for two plugs, each plug having a length of about fifteen (15) inches, the projecting height of the launcher of the present invention from the upper end of the casing has been decreased over thirty (30) inches as compared with prior launchers in which a separate hydraulic fluid cylinder is provided over the plug container.

Other objects, features and advantages of the invention will be apparent from the following specification and drawings.

PRIOR ART DESCRIPTION

Figure 1A:
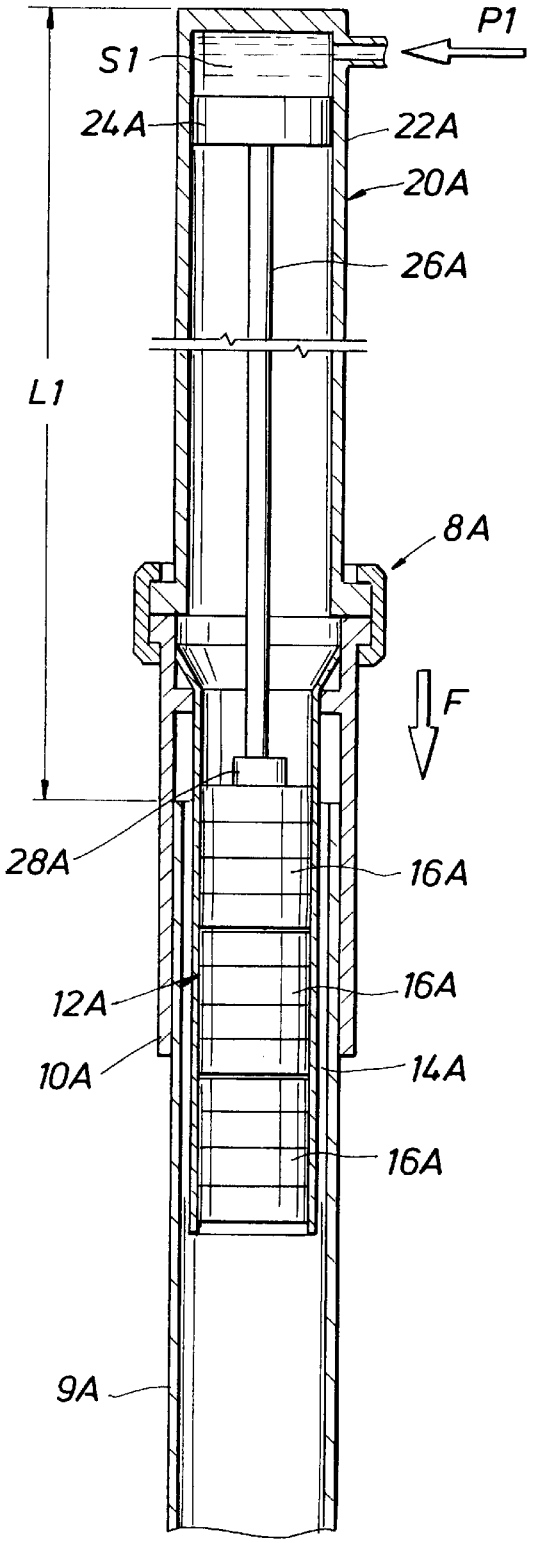
FIG. 1A (PRIOR ART)
FIG. 1A is a schematic of a prior art wiper plug launcher attached to the upper end of a plug basket or container having a piston for pushing the plugs out the open lower end of the container.

To illustrate the important differences between the prior art and the present invention, reference is made particularly to FIG. 1A in which a prior art wiper plug launcher is illustrated schematically at 8A releasably connected to the upper end of a casing. An outer connector or coupler body 10A is connected to the upper end of the casing 9A on a drilling rig receives a plug basket or container 12A therein to define an annulus 14A therebetween. Drilling fluid, cement, and other fluids are discharged into annulus 14A for flow down the casing 9A and the associated well when launcher 8A is connected to casing 9A. Plug container 12A has three wiper plugs 16A compressed therein and held by friction within container 12A. Each plug 16A has a plurality of upwardly facing elastomeric cups or fins whose edges engage the inner peripheral surface of casing 9A when expelled from the open lower end of container 12A. Plugs 16A comprise lower, middle and upper plugs 16A.

For expelling plugs 16A, a plug launching device generally indicated at 20A is coupled to the upper end of connector body 10A and has a hydraulic cylinder 22A receiving a piston 24A to define a fluid chamber S1. A piston rod 26A has a lower push member 28A which engages the upper end of upper plug 16A. The stroke of piston 24A is equal to the total length of the three plugs 16A. For example, with each plug 16A being about fifteen (15) inches in length L1, launcher device 20A for three plugs 16A extends a distance or height L1 above the upper end of casing 9A of about eighty five (85) inches. The upper end of the casing 9A projects above the floor of the drilling rig. Thus, a substantial vertical space is required on the drilling rig for the hydraulic plug launcher 8A shown in FIG. 1A.

DESCRIPTION OF THE PRESENT INVENTION

Figure 1:
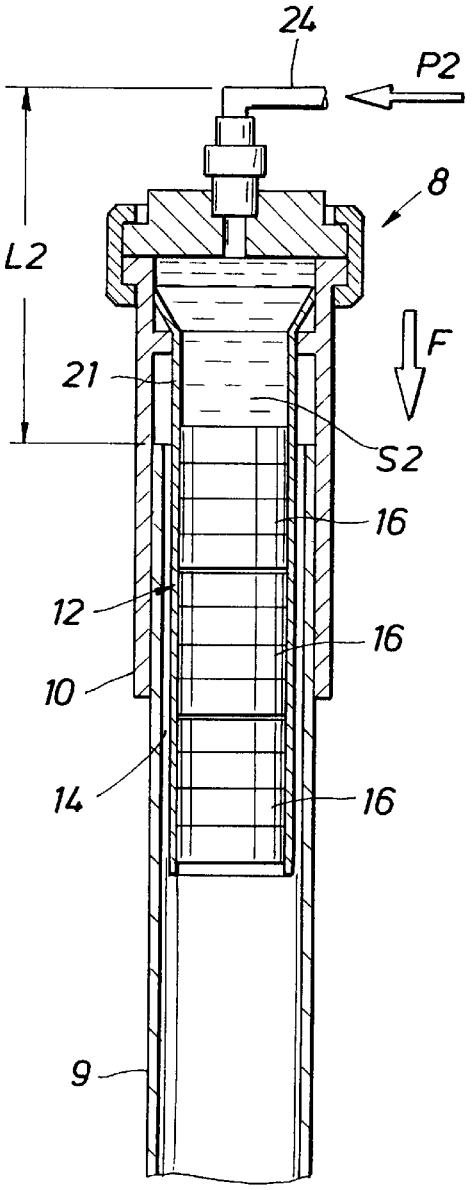
FIG. 1 is a schematic of the present invention in which the plug launcher has a plug container which forms a pressurized hydraulic fluid chamber for expelling the plugs from the lower open end of the container.

Referring now to FIG. 1 in which the present invention is shown schematically, wiper plug launcher 8 has a connector body 10 removably connected to the upper end of casing 9 and receiving a plug container 12 having three plugs 16 compressed therein. The upper end portion 21 of plug container 12 forms a hydraulic fluid chamber at S2 and pressurized hydraulic fluid from line 24 fills fluid chamber S2. The total force F provided for expelling three plugs 16 in sequence is greatest when the first plug 16 is expelled since the frictional force of all plugs 16 must be overcome in order to expel the lower plug 16. Force F is equal to the fluid pressure P2 times the surface or cross sectional area of plug container 12. Fluid chamber S2 increases in length the length of each plug 16 expelled. Since container 16 forms the fluid cylinder, the plug launcher 8 projects a distance L2 above the upper end of casing 9 which is not related to the number or plugs within container 12. A projecting height or distance L2 of about twenty four (24) inches above the upper end of the casing 9 has been found to be effective regardless of the number of wiper plugs positioned within container 12. Thus, the projecting height of plug launcher 8 above casing 9 has been reduced to a minimum as a result of having plug container 12 form the hydraulic fluid chamber and utilize the space vacated in the container by the plugs being expelled to receive hydraulic fluid and form a pressurized fluid chamber.

Referring now to FIGS. 2–5 for a more detailed showing of the invention, the wiper plug launcher shown generally at 8 is adapted to be releasably locked or coupled to an upper sleeve or collar 11 on the upper projecting end of casing 9. Casing 9 projects upwardly from the floor (not shown) of a drilling rig which may, for example, be positioned thirty (30) feet below the upper end of casing 9. Wiper plug launcher 8 has a latching coupling 22 including connector body 10 and a latch ring 25 abutting the lower edge of end collar 11. An inner downwardly facing shoulder 26 on coupler 22 engages the upper end of collar 11 in sealing relation. Suitable manually operated latches 28 urge cam 30 downwardly to cam ring 25 beneath collar 11 for releasably mounting of launcher 8 on casing 9.

For the discharge of cement slurries or other fluids into annulus 14 for flow downwardly in casing 9, discharge or inlet openings 34 in launcher body 10 are connected to suitable fluid conduits 38 for the supply of such fluids. Launcher body 10 has an upper flange 40. A hydraulic fluid cap 42 has a lower flange 44 clamped by a two piece connecting clamp 46 to upper flange 40 over launcher body 10. Hydraulic fluid supply line 24 extends to cap 42 from a suitable pressurized source (not shown) of hydraulic fluid to supply fluid to fluid chamber S2 above upper plug 16. An inner upwardly facing shoulder 49 is provided on coupler body 10.

Figure 2:
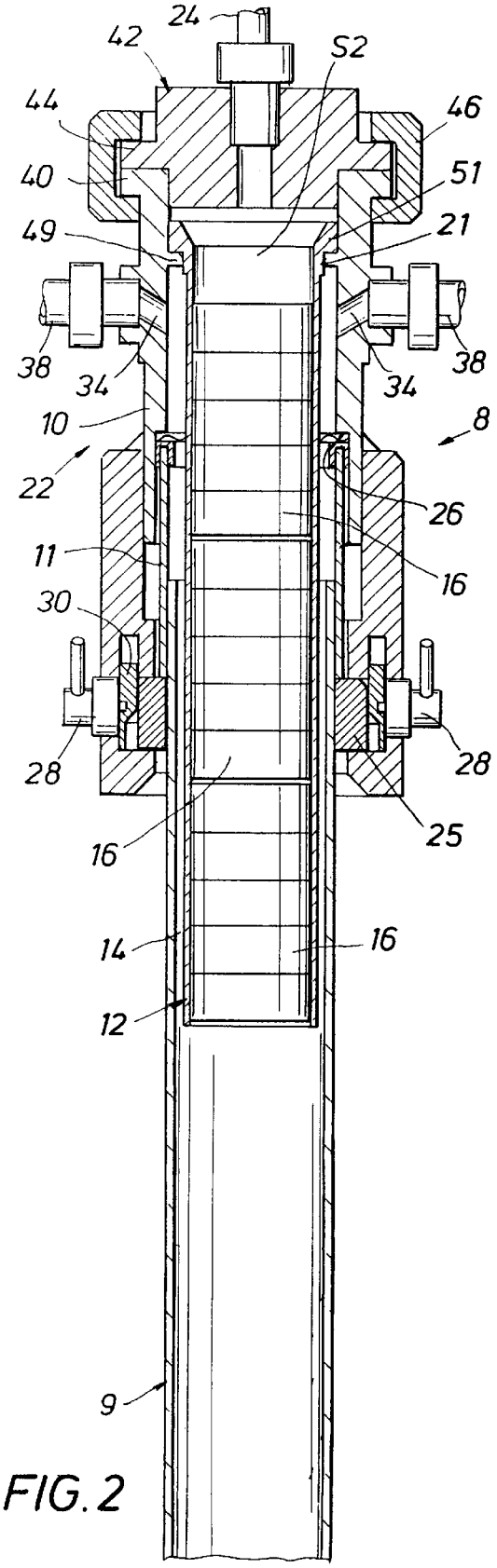
FIG. 2 is a sectional view of the present invention mounted on the upper end of a casing above the floor of a drilling rig and projecting upwardly from the casing a minimal distance, the container having a plurality of plugs mounted therein for expelling from the open lower end of the container.

Plug container or plug magazine 12 is received within connector body 10 and has an outwardly extending flange 51 supported on shoulder 49 of connector body 10 when container 12 is positioned within coupler body 10. Container 12 has open upper and lower ends as shown in FIG. 2 and three plugs 16 are loaded therein comprising a lower plug, a middle plug, and an upper plug. The present invention may be utilized with any desired number of plugs but is particularly useful for a plurality of plugs, such as three to five plugs, for example, since the prior art wiper plug launchers require an additional height for each plug. Wiper plug launcher 8 including plug container 12 when utilizing three plugs, each about fifteen (15) inches in length, would be about sixty inches in height from the lower end of container 12 to the upper end of cap 42. Cap 42 is mounted over the upper end of plug container 12 and fluid chamber S2 therein. The upper wiper plug 16 is a solid plug and hydraulic fluid is exerted against the upper surface of upper plug 16. Each plug 16 includes a plurality of upwardly directed annular fins compressed against the inner surface of container 12 and when released from the lower end of container 12, the fins expand outwardly against the inner surface of casing 9 for wiping against the inner surface thereof. Launcher 8 may provide as much as 70,000 foot pounds (lbf) for pushing the plug stack downwardly. In some instances, it may be desirable to provide a separate fluid retaining member over the upper end of the upper plug 16.

To assure that the plug stack moves downwardly in equal increments or steps with the length of fluid chamber S2 increasing an exact amount equal to the height of a plug, a precise amount of pressurized hydraulic fluid is supplied to fluid chamber S2 for expelling each of the plugs 16. The amount of hydraulic fluid supplied to chamber S2 may be determined by various control methods, such as, for example, by precisely measuring the amount of hydraulic fluid supplied to chamber S2, or moving the plug stack a precise distance equal to the length of a plug as may be determined by limit switches, stops or a computer controlled sensing system, for example.

Figure 3:
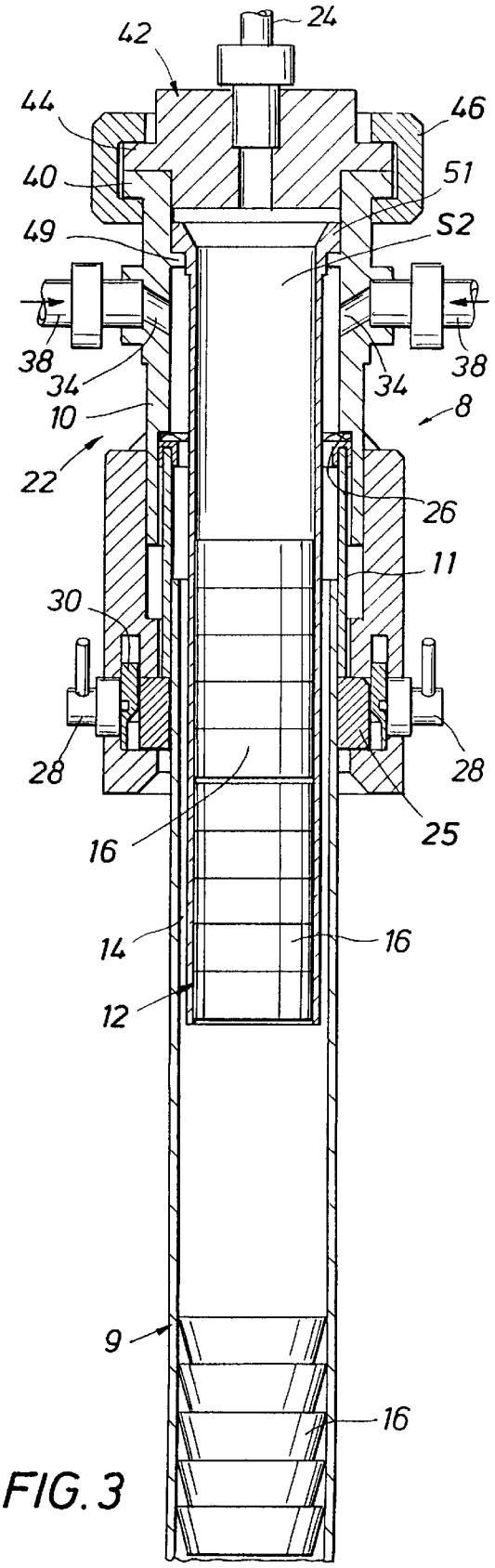
FIG. 3 is a view similar to FIG. 2 but showing the position of the plugs and length of the fluid chamber after expelling of the first plug.
Figure 4:
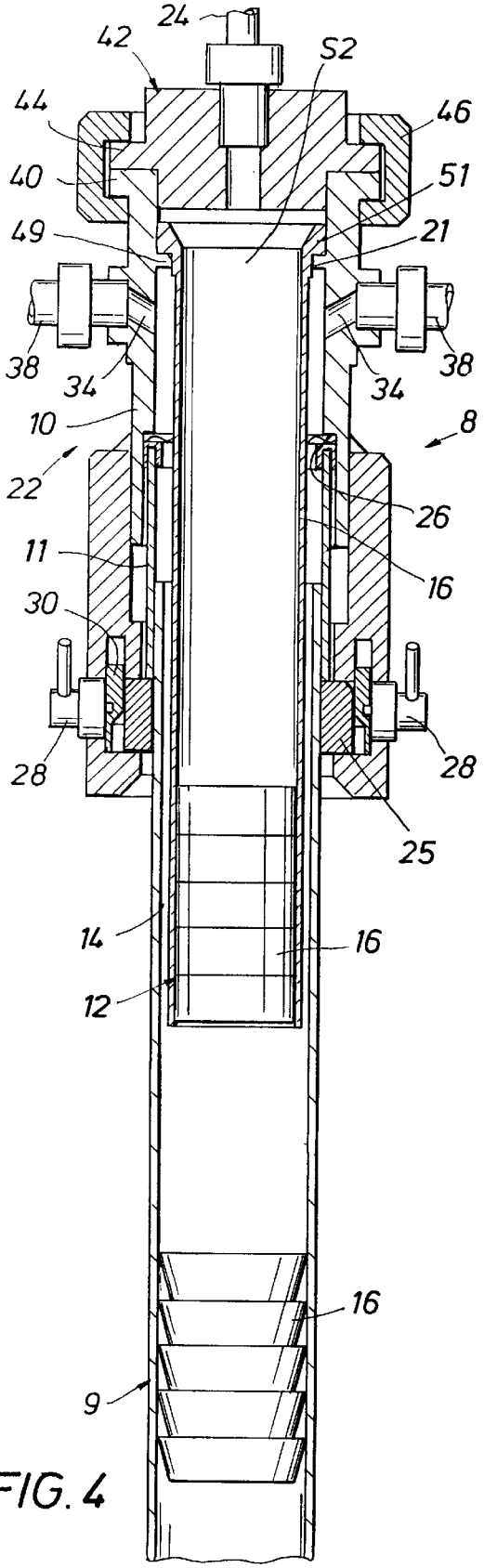
FIG. 4 is a view similar to FIG. 3 but showing the position of the plugs and length of the fluid chamber after expelling of the second plug.
Figure 5:
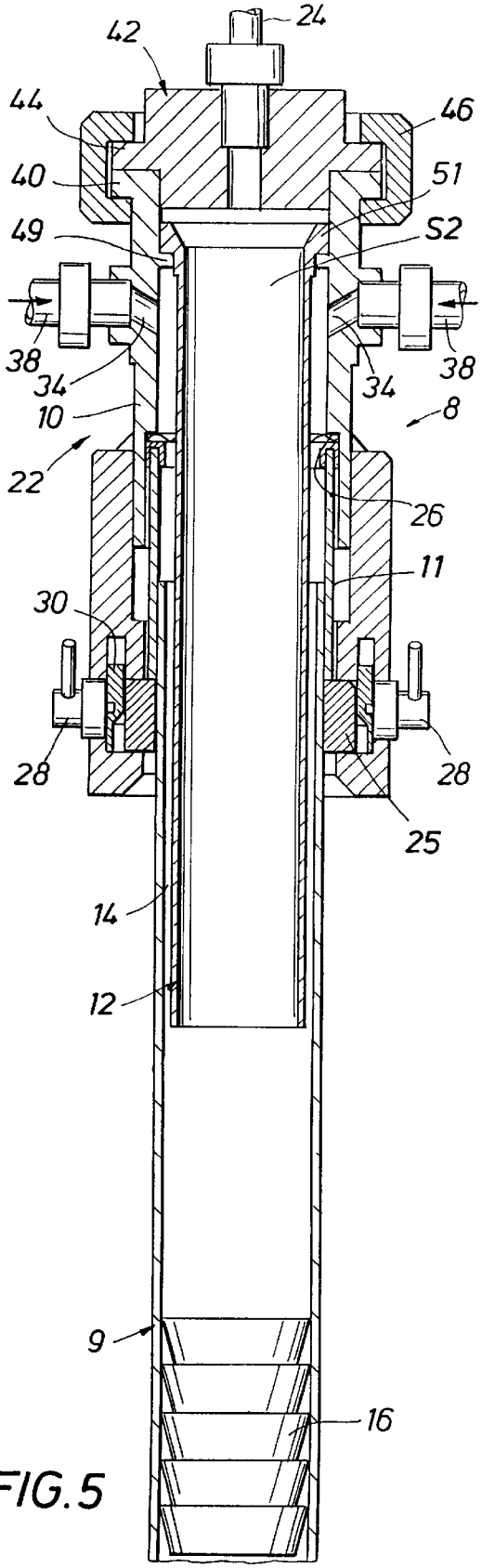
FIG. 5 is a view similar to FIG. 4 but showing the position of the plugs after expelling of the last plug.

FIGS. 3–5 show the movement of the plug stack after expelling each of the plugs 16 with the fluid chamber S2 in container 12 increasing in length a precise amount equal to the length of the plug expelled. Upon the expelling of upper plug 16 from container 12, the hydraulic fluid in container 12 which comprises water or drilling mud, for example, is discharged from the end of container 12. Thereafter, launcher 8 is unlatched from collar 11 on the upper end of casing 9 and removed for utilization with another well and associated casing.

Drilling mud is normally injected from inlet conduits 38 and inlet openings 34 into casing 9 before the expelling of the lower plug 16. After expelling of lower plug 16 as shown in FIG. 3, a predetermined fluid is injected through conduits 38 and annulus 14 into casing 9 for flow downwardly in casing 9. The middle plug 16 is expelled to form an upper cap on the lower fluid for separation of the cement slurry column, for example. Then, the upper plug 16 is expelled to separate the cement slurry from the displacement fluid.

Figure 6:
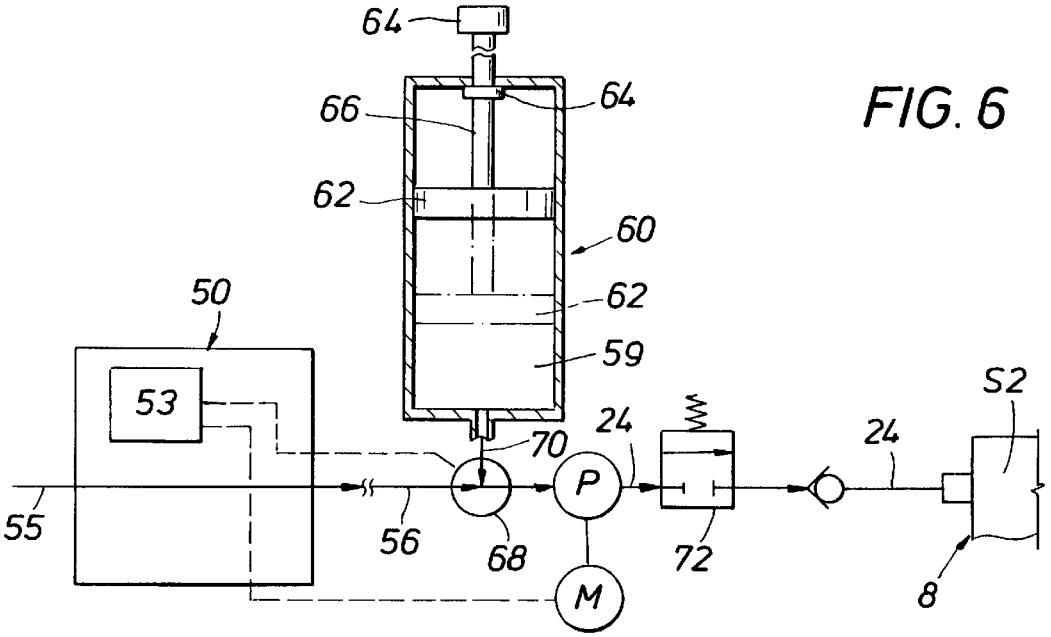
FIG. 6 is a schematic view of one embodiment of hydraulic control means to control the flow of hydraulic fluid to the plug container including a fluid loading cylinder for providing fluid to a suction line from a pump with mechanical stops to determine the fluid volume.

A suitable control box is shown generally at 50 in FIG. 6 having a manual control panel 53 therein. Hydraulic fluid, such as water, is supplied from a fluid supply 55 to fluid chamber S2 in launcher 8. The volume of fluid supplied to fluid chamber S2 may be determined by various methods and/or means. For example, the volume of hydraulic fluid supplied to fluid chamber S2 may be previously calculated and measured. Stops, such as limit switches or mechanical stops, may be provided for a fluid loading cylinder. Also, a position sensor may be provided to sense the exact position of the upper plug and to send a signal to a control valve for a predetermined supply of hydraulic fluid to fluid chamber S2.

FIG. 6 shows one embodiment in which a fluid control or loading cylinder 60 is provided to supply a predetermined volume of hydraulic fluid to fluid chamber S2. Fluid control cylinder 60 has a piston 62 thereon with opposed stops 64 on piston rod 66 to control the stroke of piston 62. Piston 62 is shown in solid lines in FIG. 6 when chamber 59 is filled and is shown in broken lines when chamber 59 is emptied for charging of fluid chamber S2. A pump P in fluid supply line 56 applies a suction to line 56 when actuated. Pump P may be driven by a suitable fluid motor M controlled from panel 53. A three way valve 68 in supply line 56 is actuated to close flow from fluid supply 55 when pump P is actuated to supply fluid to fluid chamber S2. Chamber 59 is filled with hydraulic fluid from fluid supply 55 when three way valve 68 is opened to line 70 of loading cylinder 60. A solenoid operated valve 72 is provided in pressure line 24 to fluid chamber S2.

To provide pressurized fluid to fluid chamber S2, supply line 56 to cylinder 60 is closed by three way valve 68 and pump P is actuated with solenoid operated valve 72 opened. Pump P applies a suction to fluid chamber 59 and fluid is forced through line 24 to fluid chamber S2 of launcher 8 for expelling the lower plug 16. When upper stop 64 is engaged, the stroke of piston 62 ends with a precise predetermined amount of hydraulic fluid supplied to fluid chamber S2. Solenoid valve 72 is then deenergized to move to a closed position and three way valve 68 is moved for communication of supply line 56 to cylinder 60 for refilling cylinder 60 with fluid until lower stop 64 is engaged to stop the upward movement of piston 62.

Figure 7:
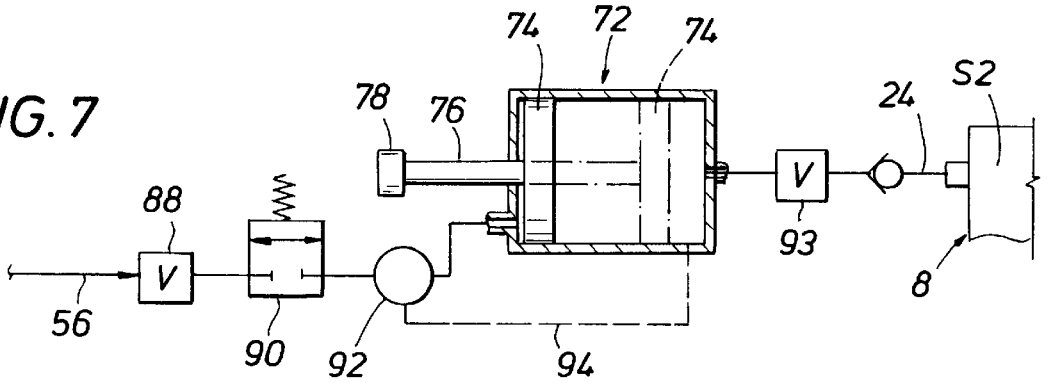
FIG. 7 is a schematic view of another embodiment of hydraulic control means similar to the embodiment of FIG. 6 but showing the fluid loading cylinder in the high pressure line to the fluid chamber.

Referring to FIG. 7, a fluid control device is shown in which high pressure fluid from line 56 is supplied to control cylinder 72 having a piston 74 therein with an integral piston rod 76 having a stop 78 thereon. Valve 88 in line 56 is moved between open and closed positions. A solenoid operated valve 90 supplies fluid to cylinder 72 when opened for movement of piston 74 a precise distance until stop 78 is engaged. Cylinder 72 upon closing of valve 93 is refilled with fluid by opening of three way valve 92 to supply fluid through line 94.

Figure 8:
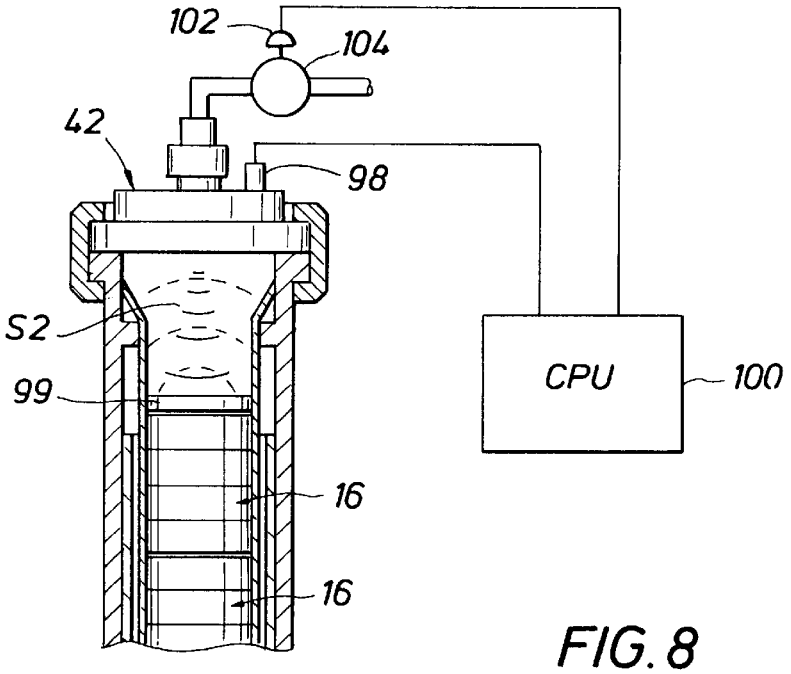
FIG. 8 is a schematic view of a still further embodiment of hydraulic control means for controlling the flow of hydraulic fluid to the plug container including a position sensor for the uppermost plug providing a signal to a computer for controlling a control valve.

FIG. 8 illustrates another embodiment to control the flow of hydraulic fluid in which a position sensor 98 is mounted on upper cap 42. A reflector disc 99 is positioned on upper plug 16 to indicate in real time at control panel 53 the exact position of upper plug 16. An input signal from sensor 98 responsive to disc 99 is received by a computer 100 which sends an output signal to control valve 102. Control valve 102 opens valve 104 for supply of fluid to fluid chamber S2 and movement of the plug stack for pushing a plug from the plug container. When the upper plug 16 reaches the predetermined position, a signal is transmitted to control valve 102 for closing valve 104 to stop the flow of hydraulic fluid to fluid chamber S2.

While mechanical stops are shown for the embodiments of FIGS. 7 and 8, it is apparent that suitable limit switches could be utilized in place of the mechanical stops, if desired. Control box 50 as shown generally in FIG. 6 would also be utilized for the embodiments of FIGS. 7 and 8.

While preferred embodiments of the present invention have been illustrated in detail, it is apparent that modifications and adaptions of the preferred embodiments will occur to those skilled in the art. However, it is to be expressly understood that such modifications and adaptations are within the spirit and scope of the present invention as set forth in the following claims.

What is claimed is:

1. A hydraulic plug launcher for mounting on the upper end of casing; said plug launcher comprising:

an open ended generally cylindrical plug container mounted within the casing to define an annulus between said container and said casing, said container having an upper end portion forming a fluid chamber for containing pressurized hydraulic fluid;

means permitting the selective flow of a predetermined fluid downwardly through said annulus about said container;

at least one wiper plug within said container having annular fins compressed against the inner peripheral surface of said container for retaining said wiper plug therein by frictional contact against said container; and hydraulic fluid pressure means providing hydraulic fluid to said upper end portion of said container defining said fluid chamber for acting against said wiper plug for pushing said wiper plug downwardly from the bottom of said container, said fluid chamber in said container increasing in length upon expelling of said plug an amount equal to the length of the wiper plug being expelled.

2. A hydraulic plug launcher as set forth in claim 1 wherein:

means control the supply of hydraulic fluid to said fluid chamber in said container to a volume substantially equal to the volume occupied by said plug in said container prior to expelling from said container.

3. A hydraulic plug launcher as set forth in claim 2 wherein said launcher extends upwardly a distance from the upper surface of said casing less than about thirty six (36) inches.

4. A hydraulic plug launcher as set forth in claim 1 wherein:

a coupling device is releasably mounted on the upper end of said casing having an outer body including a fluid inlet to receive a cement slurry;

said container with said plug therein received within said outer body and defining an annulus therebetween for the downward flow of cement slurry.

5. A hydraulic plug launcher as set forth in claim 4 wherein:

said outer body of said coupling device being generally cylindrical and having an open upper end in fluid communication with said fluid chamber in said container; and a cap over said open upper end of said outer body having a hydraulic fluid passage therein for the supply of hydraulic fluid to said fluid chamber.

6. A hydraulic plug launcher as set forth in claim 5 wherein:

said outer body has an upwardly facing inner annular shoulder therein; said container having an outwardly extending support flange thereon in abutting contact with said shoulder for supporting said container thereon.

7. A hydraulic plug launcher as set forth in claim 1 wherein a plurality of plugs are mounted within said container in a vertically stacked relation; and means to control said hydraulic fluid pressure means for pushing the uppermost plug downwardly in a series of successive steps for expelling the lowermost plug from the lower end of said container.

8. A hydraulic wiper plug launcher for mounting on the upper end of a well casing; said cement plug launcher comprising:

a generally cylindrical plug container having open upper and lower ends mounted within the casing to define an annulus between said container and said casing, said container forming a fluid chamber including said open upper end containing pressurized hydraulic fluid;

means permitting the selective flow of a predetermined fluid downwardly through said annulus about said container;

a stack of wiper plugs stacked within said container and compressed against the inner peripheral surface of said container for retaining said wiper plugs therein; and means supplying pressurized hydraulic fluid to said fluid chamber in said container for acting against the uppermost wiper plug of said stack for pushing the lowermost wiper plug downwardly from the lower end of said container in successive steps ending with the pushing of said uppermost wiper plug from the open lower end of said container, each step having a length equal to the length of the wiper plug being expelled and increasing the length of said hydraulic chamber in said container an amount equal to the length of the wiper plug being expelled.

9. A hydraulic wiper plug launcher as set forth in claim 8 wherein:

fluid control means to control the volume of fluid supplied to said hydraulic chamber for each step to a precise predetermined amount sufficient to increase the length of said hydraulic chamber an amount equal to the length of the wiper plug expelled from the container.

10. A hydraulic wiper plug launcher as set forth in claim 9 wherein said fluid control means comprises a fluid loading cylinder for supplying an equal amount of fluid to said fluid chamber for each of said successive steps.

11. A hydraulic wiper plug launcher as set forth in claim 10 wherein said fluid loading cylinder includes a piston having a stop for controlling the stroke of said piston for supplying a precise predetermined volume of hydraulic fluid to said fluid chamber.

12. A hydraulic wiper plug launcher as set forth in claim 8 wherein:

sensing means sense the position of the uppermost plug in said container;

said means supplying pressurized hydraulic fluid to said fluid chamber responsive to said sensing means to stop the flow of hydraulic fluid to said fluid chamber upon said uppermost plug reaching a predetermined position in said container.

13. A hydraulic wiper plug launcher as set forth in claim 12 wherein:

a computer is provided to receive an input signal from said sensing means; and a fluid control valve responsive to said computer is provided to control fluid flow to said fluid chamber, said computer transmitting an output signal to said control valve for opening and closing said control valve for supplying a precise predetermined volume of fluid to said fluid chamber for each of said steps.

14. A hydraulic wiper plug launcher as set forth in claim 8 wherein said launcher extends upwardly a distance from the upper surface of the casing less than about thirty six (36) inches when said container and plug stack thereon is loaded within said launcher.

15. A hydraulic wiper plug launcher as set forth in claim 8 wherein:

an outer body is mounted on the upper end of said casing and includes a fluid inlet to receive said predetermined fluid;

said container with said plug stack therein received within said outer body and defining an annulus therebetween for the downward flow of said predetermined fluid.

16. A hydraulic wiper plug launcher as set forth in claim 15 wherein:

said outer body is generally cylindrical and has an open upper end in fluid communication with said fluid chamber in said container; and a cap over said open upper end of said outer body having a hydraulic fluid passage therein for the supply of hydraulic fluid to said fluid chamber.

17. A hydraulic wiper plug launcher as set forth in claim 16 wherein:

said outer body has an upwardly facing inner annular shoulder therein; said container having an outwardly extending support flange thereon in abutting contact with said shoulder for supporting said container thereon.

* * * * *